US009494287B2

(12) United States Patent
Quirion et al.

(10) Patent No.: US 9,494,287 B2
(45) Date of Patent: Nov. 15, 2016

(54) LED LAMP ASSEMBLY FOR SEALED OPTICAL LUMINAIRES

(71) Applicant: SQ TECHNOLOGIES INC., Saint-Georges (CA)

(72) Inventors: Steeve Quirion, Saint-Georges (CA); Robert Lachance, Saint-Georges (CA); Michel Bernard, Beauceville (CA); Chrisnel Blot, Dollard-des-Ormeaux (CA)

(73) Assignee: SQ TECHNOLOGIES INC., Saint-Georges, QC (CA)

( * ) Notice: Subject to any disclaimer, the term of this patent is extended or adjusted under 35 U.S.C. 154(b) by 68 days.

(21) Appl. No.: 14/534,222

(22) Filed: Nov. 6, 2014

(65) Prior Publication Data

US 2015/0062912 A1 Mar. 5, 2015

Related U.S. Application Data

(62) Division of application No. 13/568,428, filed on Aug. 7, 2012, now Pat. No. 9,133,995.

(30) Foreign Application Priority Data

Apr. 12, 2012 (CA) ..... 2774354

(51) Int. Cl.
*F21S 8/08* (2006.01)
*F21V 31/00* (2006.01)
(Continued)

(52) U.S. Cl.
CPC ..... *F21S 8/086* (2013.01); *F21V 23/009* (2013.01); *F21V 29/2206* (2013.01); *F21V 29/507* (2015.01); *F21V 29/74* (2015.01); *F21V 31/00* (2013.01); *F21W 2131/103* (2013.01); *F21Y 2101/02* (2013.01); *F21Y 2105/001* (2013.01)

(58) Field of Classification Search
CPC ..... F21V 29/22; F21V 29/2206; F21V 29/2212; F21V 29/26; F21V 29/262; F21V 31/005; F21W 2131/103; F21W 2131/105; F21W 2131/101; F21W 2131/001; F21W 2131/10; F21W 2131/1005; F21S 8/086; F21Y 2105/001; F21Y 2105/003; F21Y 2105/005; F21Y 2101/02; F21Y 2105/006; Y02B 20/72
USPC ..... 362/294, 373, 218, 249.02, 311.02, 362/249.03, 249.04, 249.05, 249.06, 153, 362/153.1, 267
See application file for complete search history.

(56) References Cited

U.S. PATENT DOCUMENTS 7,637,633 B2 * 12/2009 Wong ..... F21K 9/00 362/218
8,702,278 B2 * 4/2014 Wang ..... F21K 9/30 362/218
2011/0007505 A1 * 1/2011 Wang ..... F21S 8/086 362/235

*Primary Examiner* — Robert May
(74) *Attorney, Agent, or Firm* — Norton Rose Fulbright Canada LLP

(57) ABSTRACT

A sealed optical street luminaire having a luminaire housing fitted with a clear, flat lens and provided with an LED light source assembly mounted in the housing. The light source assembly has a heat dissipating LED support member secured to a heat conductive adapter for securement in the luminaire housing. A reflector is secured in the luminaire housing behind the lens which is sealingly positioned about the reflector. The LED support member supports LED modules at a predetermined angle and orientation relative to an inner reflective surface of the circumferential wall of the reflector. The heat dissipating LED support member and the heat conductive adapter dissipate heat through the luminaire housing.

18 Claims, 21 Drawing Sheets

(51) Int. Cl.

| | |
|---|---|
| ***F21V 23/00*** | (2015.01) |
| ***F21V 29/507*** | (2015.01) |
| ***F21V 29/74*** | (2015.01) |
| ***F21V 29/00*** | (2015.01) |
| *F21Y 105/00* | (2016.01) |
| *F21W 131/103* | (2006.01) |
| *F21Y 101/02* | (2006.01) |

| Road and Pedestrian Conflict Area | | Pavement Classification | | | Uniformity ratio | Veiling luminance ratio |
|---|---|---|---|---|---|---|
| Road | Pedestrian conflict area | R1 | R2 & R3 | R4 | $E_{avg}/E_{min}$ | $L_{vmax}/L_{avg}$ |
| Freeway Class A | | 6 lx | 9 lx | 8 lx | 3.0 | 0.3 |
| Freeway Class B | | 4 lx | 6 lx | 5 lx | 3.0 | 0.3 |
| Expressway | High | 10 lx | 14 lx | 13 lx | 3.0 | 0.3 |
| | Medium | 8 lx | 12 lx | 10 lx | 3.0 | 0.3 |
| | Low | 6 lx | 9 lx | 8 lx | 3.0 | 0.3 |
| Major | High | 12 lx | 17 lx | 15 lx | 3.0 | 0.3 |
| | Medium | 9 lx | 13 lx | 11 lx | 3.0 | 0.3 |
| | Low | 6 lx | 9 lx | 8 lx | 3.0 | 0.3 |
| Collector | High | 8 lx | 12 lx | 10 lx | 4.0 | 0.4 |
| | Medium | 6 lx | 9 lx | 8 lx | 4.0 | 0.4 |
| | Low | 4 lx | 6 lx | 5 lx | 4.0 | 0.4 |
| Local | High | 6 lx | 9 lx | 8 lx | 6.0 | 0.4 |
| | Medium | 5 lx | 7 lx | 6 lx | 6.0 | 0.4 |
| | Low | 3 lx | 4 lx | 4 lx | 6.0 | 0.4 |

FIG. 10

| | Units | Layout #1 | Layout #2 | Layout #3 |
|---|---|---|---|---|
| Luminaire Spacing (within Row) | Ft | 120 | 150 | 180 |
| Luminance - Avg | Cd/Sq.M. | 1.04 | 0.83 | 0.69 |
| Luminance - Max | Cd/Sq.M. | 2.4 | 2.3 | 2.1 |
| Luminance - Min | Cd/Sq.M. | 0.4 | 0.3 | 0.2 |
| Avg/Min | | 2.6 | 2.77 | 3.45 |
| Max/Min | | 6 | 7.67 | 10.5 |
| Maximum Lv/Lavg Ratio | | 0.3 | 0.36 | 0.44 |
| Weighted Average VL (STV) | | 1.92 | 2.28 | 3.58 |
| Maximum Veiling Luminance | Cd/Sq.M. | 0.31 | 0.3 | 0.3 |
| Relative Thresold Increment (%) | | N.A. | N.A. | N.A. |
| Discomfort Glare Control Mark | | N.A. | N.A. | N.A. |
| Longitudinal Uniformity (Obs) | | N.A. | N.A. | N.A. |
| Illuminance - Avg | Lux | 12.74 | 10.17 | 8.47 |
| Illuminance - Max | Lux | 25 | 23.5 | 23 |
| Illuminance - Min | Lux | 6.4 | 4.6 | 3 |
| Avg/Min | | 1.99 | 2.21 | 2.82 |
| Max/Min | | 3.91 | 5.11 | 7.67 |
| Luminaire Label | | S1201312-R1 | S1201312-R1 | S1201312-R1 |
| Luminaire Arrangement | | SINGLE | SINGLE | SINGLE |
| Arm Length | Ft | 8 | 8 | 8 |
| Mounting Height | Ft | 30 | 30 | 30 |
| Tilt | | 0 | 0 | 0 |
| Flashed Area | Sq.Ft. | N.A. | N.A. | N.A. |
| Color Constant | | N.A. | N.A. | N.A. |
| Specific Luminaire Index | | N.A. | N.A. | N.A. |
| Layout Type | | 2R_OPP_MM | 2R_OPP_MM | 2R_OPP_MM |
| Roadway Width | Ft | 24 | 24 | 24 |
| Setback | Ft | 6 | 6 | 6 |
| Lanes Per Roadway | | 2 | 2 | 2 |
| Median Width | Ft | 6 | 6 | 6 |
| R - Table | | R3 | R3 | R3 |
| Calculation Method | | IES | IES | IES |

FIG. 11A

| | Units | Layout #1 | Layout #2 | Layout #3 |
|---|---|---|---|---|
| Luminaire Spacing (within Row) | Ft | 120 | 150 | 180 |
| Luminance - Avg | Cd/Sq.M. | 0.96 | 0.77 | 0.65 |
| Luminance - Max | Cd/Sq.M. | 1.9 | 1.8 | 1.7 |
| Luminance - Min | Cd/Sq.M. | 0.4 | 0.3 | 0.2 |
| Avg/Min | | 2.4 | 2.57 | 3.25 |
| Max/Min | | 4.75 | 6 | 8.5 |
| Maximum Lv/Lavg Ratio | | 0.25 | 0.3 | 0.35 |
| Weighted Average VL (STV) | | 1.91 | 2.36 | 3.6 |
| Maximum Veiling Luminance | Cd/Sq.M. | 0.24 | 0.23 | 0.23 |
| Relative Thresold Increment (%) | | N.A. | N.A. | N.A. |
| Discomfort Glare Control Mark | | N.A. | N.A. | N.A. |
| Longitudinal Uniformity (Obs) | | N.A. | N.A. | N.A. |
| Illuminance - Avg | Lux | 12.21 ✓ | 9.76 | 8.12 |
| Illuminance - Max | Lux | 24.4 | 23.1 | 22.6 |
| Illuminance - Min | Lux | 7.2 | 5.1 | 2.9 |
| Avg/Min | | 1.7 | 1.91 | 2.8 |
| Max/Min | | 3.39 | 4.53 | 7.79 |
| Luminaire Label | | S1201313-R1 | S1201313-R1 | S1201313-R1 |
| Luminaire Arrangement | | SINGLE | SINGLE | SINGLE |
| Arm Length | Ft | 8 | 8 | 8 |
| Mounting Height | Ft | 30 | 30 | 30 |
| Tilt | | 0 | 0 | 0 |
| Flashed Area | Sq.Ft. | N.A. | N.A. | N.A. |
| Color Constant | | N.A. | N.A. | N.A. |
| Specific Luminaire Index | | N.A. | N.A. | N.A. |
| Layout Type | | 2R_OPP_MM | 2R_OPP_MM | 2R_OPP_MM |
| Roadway Width | Ft | 24 ✓ | 24 ✓ | 24 ✓ |
| Setback | Ft | 6 | 6 | 6 |
| Lanes Per Roadway | | 2 | 2 | 2 |
| Median Width | Ft | 6 | 6 | 6 |
| R - Table | | R3 | R3 | R3 |
| Calculation Method | | IES | IES | IES |

FIG. 11B

| | Units | Layout #1 | Layout #2 | Layout #3 |
|---|---|---|---|---|
| Luminaire Spacing (within Row) | Ft | 120 | 150 | 180 |
| Luminance - Avg | Cd/Sq.M. | 0.82 | 0.65 | 0.55 |
| Luminance - Max | Cd/Sq.M. | 1.3 | 1.2 | 1.2 |
| Luminance - Min | Cd/Sq.M. | 0.4 | 0.3 | 0.3 |
| Avg/Min | | 2.05 | 2.17 | 1.83 |
| Max/Min | | 3.25 | 4 | 4 |
| Maximum Lv/Lavg Ratio | | 0.19 | 0.24 | 0.27 |
| Weighted Average VL (STV) | | 2.26 | 2.95 | 3.96 |
| Maximum Veiling Luminance | Cd/Sq.M. | 0.15 | 0.15 | 0.15 |
| Relative Thresold Increment (%) | | N.A. | N.A. | N.A. |
| Discomfort Glare Control Mark | | N.A. | N.A. | N.A. |
| Longitudinal Uniformity (Obs) | | N.A. | N.A. | N.A. |
| Illuminance - Avg | Lux | 11.64 | 9.31 | 7.73 |
| Illuminance - Max | Lux | 23.8 | 22.8 | 22.4 |
| Illuminance - Min | Lux | 7.5 | 4 | 1.8 |
| Avg/Min | | 1.55 | 2.33 | 4.29 |
| Max/Min | | 3.17 | 5.7 | 12.44 |
| Luminaire Label | | S1201311-R1 | S1201311-R1 | S1201311-R1 |
| Luminaire Arrangement | | SINGLE | SINGLE | SINGLE |
| Arm Length | Ft | 8 | 8 | 8 |
| Mounting Height | Ft | 30 | 30 | 30 |
| Tilt | | 0 | 0 | 0 |
| Flashed Area | Sq.Ft. | N.A. | N.A. | N.A. |
| Color Constant | | N.A. | N.A. | N.A. |
| Specific Luminaire Index | | N.A. | N.A. | N.A. |
| Layout Type | | 2R_OPP_MM | 2R_OPP_MM | 2R_OPP_MM |
| Roadway Width | Ft | 24 | 24 | 24 |
| Setback | Ft | 6 | 6 | 6 |
| Lanes Per Roadway | | 2 | 2 | 2 |
| Median Width | Ft | 6 | 6 | 6 |
| R - Table | | R3 | R3 | R3 |
| Calculation Method | | IES | IES | IES |

FIG. 11C

| | Units | Layout #1 | Layout #2 | Layout #3 |
|---|---|---|---|---|
| Luminaire Spacing (within Row) | Ft | 120 | 150 | 180 |
| Luminance - Avg | Cd/Sq.M. | 0.76 | 0.61 | 0.51 |
| Luminance - Max | Cd/Sq.M. | 2.1 | 2 | 1.8 |
| Luminance - Min | Cd/Sq.M. | 0.2 | 0.2 | 0.1 |
| Avg/Min | | 3.8 | 3.05 | 5.1 |
| Max/Min | | 10.5 | 10 | 18 |
| Maximum Lv/Lavg Ratio | | 0.36 | 0.43 | 0.52 |
| Weighted Average VL (STV) | | 1.9 | 2.16 | 3.2 |
| Maximum Veiling Luminance | Cd/Sq.M. | 0.27 | 0.26 | 0.27 |
| Relative Thresold Increment (%) | | N.A. | N.A. | N.A. |
| Discomfort Glare Control Mark | | N.A. | N.A. | N.A. |
| Longitudinal Uniformity (Obs) | | N.A. | N.A. | N.A. |
| Illuminance - Avg | Lux | 9.8 | 7.84 | 6.52 |
| Illuminance - Max | Lux | 22.7 | 21.4 | 21 |
| Illuminance - Min | Lux | 3 | 2 | 1.4 |
| Avg/Min | | 3.27 | 3.92 | 4.66 |
| Max/Min | | 7.57 | 10.7 | 15 |
| Luminaire Label | | S1201312-R1 | S1201312-R1 | S1201312-R1 |
| Luminaire Arrangement | | SINGLE | SINGLE | SINGLE |
| Arm Length | Ft | 8 | 8 | 8 |
| Mounting Height | Ft | 30 | 30 | 30 |
| Tilt | | 0 | 0 | 0 |
| Flashed Area | Sq.Ft. | N.A. | N.A. | N.A. |
| Color Constant | | N.A. | N.A. | N.A. |
| Specific Luminaire Index | | N.A. | N.A. | N.A. |
| Layout Type | | 2R_OPP_MM | 2R_OPP_MM | 2R_OPP_MM |
| Roadway Width | Ft | 36 | 36 | 36 |
| Setback | Ft | 4 | 4 | 4 |
| Lanes Per Roadway | | 3 | 3 | 3 |
| Median Width | Ft | 8 | 8 | 8 |
| R - Table | | R3 | R3 | R3 |
| Calculation Method | | IES | IES | IES |

FIG. 12A

| | Units | Layout #1 | Layout #2 | Layout #3 |
|---|---|---|---|---|
| Luminaire Spacing (within Row) | Ft | 120 | 150 | 180 |
| Luminance - Avg | Cd/Sq.M. | 0.74 | 0.58 | 0.48 |
| Luminance - Max | Cd/Sq.M. | 1.6 | 1.5 | 1.4 |
| Luminance - Min | Cd/Sq.M. | 0.2 | 0.2 | 0.1 |
| Avg/Min | | 3.7 | 2.9 | 4.8 |
| Max/Min | | 8 | 7.5 | 14 |
| Maximum Lv/Lavg Ratio | | 0.27 | 0.33 | 0.39 |
| Weighted Average VL (STV) | | 1.99 | 2.31 | 3.23 |
| Maximum Veiling Luminance | Cd/Sq.M. | 0.2 | 0.19 | 0.19 |
| Relative Thresold Increment (%) | | N.A. | N.A. | N.A. |
| Discomfort Glare Control Mark | | N.A. | N.A. | N.A. |
| Longitudinal Uniformity (Obs) | | N.A. | N.A. | N.A. |
| Illuminance - Avg | Lux | 9.61 | 7.67 | 6.38 |
| Illuminance - Max | Lux | 22.2 | 21 | 20.6 |
| Illuminance - Min | Lux | 4.1 | 3 | 2.2 |
| Avg/Min | | 2.34 | 2.56 | 2.9 |
| Max/Min | | 5.41 | 7 | 9.36 |
| Luminaire Label | | S1201313-R1 | S1201313-R1 | S1201313-R1 |
| Luminaire Arrangement | | SINGLE | SINGLE | SINGLE |
| Arm Length | Ft | 8 | 8 | 8 |
| Mounting Height | Ft | 30 | 30 | 30 |
| Tilt | | 0 | 0 | 0 |
| Flashed Area | Sq.Ft. | N.A. | N.A. | N.A. |
| Color Constant | | N.A. | N.A. | N.A. |
| Specific Luminaire Index | | N.A. | N.A. | N.A. |
| Layout Type | | 2R_OPP_MM | 2R_OPP_MM | 2R_OPP_MM |
| Roadway Width | Ft | 36 | 36 | 36 |
| Setback | Ft | 4 | 4 | 4 |
| Lanes Per Roadway | | 3 | 3 | 3 |
| Median Width | Ft | 8 | 8 | 8 |
| R - Table | | R3 | R3 | R3 |
| Calculation Method | | IES | IES | IES |

FIG. 12B

| | Units | Layout #1 | Layout #2 | Layout #3 |
|---|---|---|---|---|
| Luminaire Spacing (within Row) | Ft | 120 | 150 | 180 |
| Luminance - Avg | Cd/Sq.M. | 0.64 | 0.51 | 0.43 |
| Luminance - Max | Cd/Sq.M. | 1.2 | 1 | 1 |
| Luminance - Min | Cd/Sq.M. | 0.2 | 0.2 | 0.1 |
| Avg/Min | | 3.2 | 2.55 | 4.3 |
| Max/Min | | 6 | 5 | 10 |
| Maximum Lv/Lavg Ratio | | 0.23 | 0.28 | 0.33 |
| Weighted Average VL (STV) | | 2.29 | 2.69 | 3.52 |
| Maximum Veiling Luminance | Cd/Sq.M. | 0.15 | 0.14 | 0.14 |
| Relative Thresold Increment (%) | | N.A. | N.A. | N.A. |
| Discomfort Glare Control Mark | | N.A. | N.A. | N.A. |
| Longitudinal Uniformity (Obs) | | N.A. | N.A. | N.A. |
| Illuminance - Avg | Lux | 9.38 | 7.49 | 6.23 |
| Illuminance - Max | Lux | 21.6 | 20.7 | 20.4 |
| Illuminance - Min | Lux | 5.1 | 3.3 | 1.6 |
| Avg/Min | | 1.84 | 2.27 | 3.89 |
| Max/Min | | 4.24 | 6.27 | 12.75 |
| Luminaire Label | | S1201311-R1 | S1201311-R1 | S1201311-R1 |
| Luminaire Arrangement | | SINGLE | SINGLE | SINGLE |
| Arm Length | Ft | 8 | 8 | 8 |
| Mounting Height | Ft | 30 | 30 | 30 |
| Tilt | | 0 | 0 | 0 |
| Flashed Area | Sq.Ft. | N.A. | N.A. | N.A. |
| Color Constant | | N.A. | N.A. | N.A. |
| Specific Luminaire Index | | N.A. | N.A. | N.A. |
| Layout Type | | 2R_OPP_MM | 2R_OPP_MM | 2R_OPP_MM |
| Roadway Width | Ft | 36 | 36 | 36 |
| Setback | Ft | 4 | 4 | 4 |
| Lanes Per Roadway | | 3 | 3 | 3 |
| Median Width | Ft | 8 | 8 | 8 |
| R - Table | | R3 | R3 | R3 |
| Calculation Method | | IES | IES | IES |

FIG. 12C

| First number (Protection against solid objects) | Definition | Second number (Protection against liquids) | Definition |
|---|---|---|---|
| 0 | No protection | 0 | No protection |
| 1 | Protected against solids objects over 50mm (e.g. accidental touch by hands | 1 | Protected against vertically falling drops of water |
| 2 | Protected against solids objects over 12mm (e.g. fingers) | 2 | Protected against direct sprays up to 15° from the vertical |
| 3 | Protected against solids objects over 2.5mm (e.g. tools and wires) | 3 | Protected against direct sprays up to 60° from the vertical |
| 4 | Protected against solids objects over 1mm (e.g. tools, wires and small wires | 4 | Protected against sprays from all directions - limited ingress permitted |
| | Protected against dust - limited ingress (no harmful deposit) | 5 | Protected against low pressure jets if water from all directions - limited ingress permitted |
| 6 | Totally protected against dust | 6 | Protected against strong jets of water e.g. for use on shipdecks - limited ingress permitted |
| | | 7 | Protected against the effects of temporary immersion between 15cm and 1m. Duration of test 30 minutes |
| | | 8 | Protected against long periods of immersion under pressure |

FIG. 13

| | Start | Middle | End | End Normalized |
|---|---|---|---|---|
| Date/Time | 2012/01/30 17:06:24 | 2012/01/30 20:51:37 | 2012/01/31 00:36:41 | 2012/01/31 00:36:41 |
| Input Voltage | 117.70 | 120.00 | 118.80 | 118.80 |
| Input Current | 0.6740 | 0.6450 | 0.6500 | 0.6500 |
| Input Power | 79.3000 | 77.2000 | 77.1000 | 77.1000 |
| 1: Ambient | 23.5 | 24.9 | 24.9 | 25.0 |
| 2: LED #1 | 30.6 | 70.5 | 72.3 | 72.4 |
| 3: LED #2 | 31.7 | 73.0 | 75.1 | 75.2 |
| 4: Driver TC | 24.4 | 58.3 | 59.5 | 59.6 |
| 5: Driver Near Reflector | 24.5 | 56.7 | 57.9 | 58.0 |
| 6: Luminaire Ambient | 25.3 | 55.2 | 56.6 | 56.7 |

FIG. 14

| | |
|---|---|
| Peak Wavelength | 443 nm |
| Luminous Flux | 5152 lm |
| Input Power | 76.12 W |
| Lumens/Watt | 67.7 |
| Full Width/Half Maximum | 25.69 |
| Center Wavelength | 442 nm |
| Centroid Wavelength | 163 nm |
| Dominant Wavelength | 487 nm |
| Excitation Purity | 0.3019 |
| Colorimeric Purity | 0.1944 |

Luminaire: Retrofit SQ DEL · Lumcat: 2XFORTIMO36W5700K

Maximum Plane and Maximum Cone Plots of Candela (1)

Luminaire: Retrofit SQ DEL Lumcat: 2XFORTIMO36W5700K

Maximum Plane and Maximum Cone Plots of Candela (1)

Luminaire: Retrofit SQ DEL Lumcat: 2XFORTIMO36W5700K

Maximum Plane and Maximum Cone Plots of Candela (1)

LED LAMP ASSEMBLY FOR SEALED OPTICAL LUMINAIRES

CROSS-REFERENCE TO RELATED APPLICATION

This application is a divisional of U.S. patent application Ser. No. 13/568,428, filed on Aug. 7, 2012, which claims foreign priority under 35 U.S.C. 119(a)-(d) on Canadian Patent Application No. 2,774,354 filed on Apr. 12, 2012, the contents on which are hereby incorporated by reference.

TECHNICAL FIELD

The present invention relates to an LED lamp assembly for sealed optical lamp and more particularly, but not exclusively, to a sealed optical street luminaire.

BACKGROUND ART

There are several advantages of using light emitting diodes for street lighting. However, such luminaires are supported elevated from streets at a sufficient height whereby the LED's are required to generate sufficient power to provide the necessary lumens on the plane to be lit, herein street lanes and adjacent spaces. The lumen generated by the LED's need to meet established standards to provide a uniform photometric distribution pattern and this according to the type of road to be lit whereby to accommodate the visual needs of drivers and pedestrians. It is also important to minimize glare and light pollution. An advantage of using LEDs is that the electric energy consumed is much reduced as compared to conventional sources, such as sodium, metal halide and mercury light high pressure. Also, LED luminaires require very little maintenance if the critical thermal temperature of the LED's is maintained within manufactured specification whereby the LED's can achieve their life-time rating which is considerably more than conventional luminaires. Therefore, all of this translates in considerable savings in power and cost to maintain LED luminaires.

When using LED's for street luminaires it is important that the street lamps or luminaires meet the photometric requirements of specific applications in a most energy efficient manner and there are regulations concerning the performance of such street lighting application when using LED light sources. The metric Luminaire System Application Efficacy (LSAE) was devised to evaluate the delivery of light where needed in a most energy-efficient manner. LSAE is a good predictor of energy efficiency to rank individual luminaires or groups of luminaires staggered in a specific lay-out in relation to a roadway. The American National Standard practice for roadway lighting, RP-08-00 (IESNA 2000) has published a Table of recommended maintain-average horizontal illuminance levels for different types of roads, pavement and pedestrian conditions. These recommendations are published in a document entitled "Recommendations For Evaluating Street and Roadway Luminaires", volume 10, Issue 1, April 2011. Therefore, when constructing street luminaires using light emitting diodes as the light source, it is of utmost importance that these recommendations be met. It is also important to note that the more luminous flux falling on a plane to be lit, otherwise known as the task plane, the better maximum pole spacing can be achieved thereby further reducing cost of a street luminaire system for a specific pavement classification as defined by the IESNA recommendations.

It is also important with street lighting to reduce glare which is a critical issue in street and roadway luminaire design for illuminating large areas at night. It is therefore important to consider the luminous flux exiting a luminaire at a certain angle, the height of the luminaire from the task plane to be lit and the spacing between luminaires whereby to evaluate glare. This is important also in the calculation of pole spacing for given sets of conditions as set forth in the above-mentioned recommendations published by IESNA. Light that extends to angles greater than 90° from the luminaire is considered waste light or light pollution and the luminaire needs to be designed to substantially reduce or eliminate this light pollution and thereby resulting in an increase in lumens generated in a desired oriented photometric distribution pattern. The above referred-to Publication further includes Tables wherein pole mounting and spacing requirements have been established in relation to input power, and luminous efficacity (lumens/watt). Such Table establishes in the number of poles per mile and the power demand in kilowatts per mile.

SUMMARY

A feature of the present invention is to provide a sealed optical luminaire which takes into consideration all of the above recommendations of IESNA and meets these requirements. As well, the sealed optical luminaire of the present invention also meets the critical thermal temperature $T_c$ of LED modules utilized as the light sources for the luminaires and thereby achieve the life rating of these modules which is a critical factor in achieving the guaranteed life span of the LED modules which in turn provide the above-mentioned benefits of the use of LED's.

Another feature of the present invention is to provide a sealed optical luminaire, preferably, but not exclusively, a street luminaire and wherein the light source is composed of LED modules, each of the modules comprising a plurality of LED's and wherein the modules are mounted on a heat dissipating support member which is secured to a heat conductive adapter wherein heat generated by the LEDs is transferred rapidly and dissipated through the heat conductive adapter and a light housing in contact therewith for a retrofit application.

Another feature of the present invention is to construct a luminaire having a type distribution and capable of meeting RP.08 Standard for expressways of R2 and R3 pavement-type with a wattage rating below 80 watts with a pole spacing of 120 ft and a luminaire height of 30 ft.

Another feature of the present invention is to provide a luminaire meeting a high IP rating with respect to dust and water resistance.

Another feature of the present invention is to provide a sealed optical street luminaire and wherein the LED light source is comprised of high brightness LED modules (HBM) and wherein said LED modules are capable of generating a high luminous efficacy while the critical thermal temperature $T_c$ of said LED modules is maintained below manufacturer specification to achieve the lifetime rating of said LED modules.

Another feature of the present invention is to provide a sealed optical street luminaire and wherein the LED light source is adjustably mounted to alter the light distribution pattern on a plane to be lit wherein to provide for high, medium and low pedestrian conflict areas lighting for an R1, R2 and R3 pavement classification.

According to the above features, from a broad aspect, the present invention provides a sealed optical street luminaire having a lamp housing fitted with a clear, flat lens. An LED light source assembly is mounted in the housing. The LED light source assembly has a heat dissipating LED support member. A heat conductive adapter is provided for securement in the luminaire housing with at least portions thereof in contact with at least a heat conductive portion of the luminaire housing. A reflector is secured in the luminaire housing behind the lens. A seal is secured about a circumferential side wall of the reflector and disposed for sealing engagement with the lens. The LED support member has an LED support outer surface for securement of one or more high power LED modules at a predetermined angle and orientation relative to an inner reflective surface of the circumferential side wall of the reflector whereby to produce a desired oriented photometric light distribution pattern on a plane to be illuminated. The heat dissipating LED support member transfers heat generated by the LED modules directly into the heat conductive adapter for dissipation through the luminaire housing and has a heat dissipating capacity to operate the LED modules at a lower temperature than the critical thermal temperature $T_c$ of the LED modules specified by manufacturer specification to achieve life span, photometric and colorometric rating of the LED modules while generating required lumens in conformity with photometric requirements for the plane to be illuminated.

According to a further broad aspect of the present invention there is provided an indoor sealed optical luminaire comprising a heat conductive support forming a head of the luminaire. The heat conductive support has a reflector secured in a flat lower surface portion thereof. A clear, flat lens is sealingly secured about a circumferential side wall of the reflector. A heat dissipating LED support member is secured to the flat lower surface portion of the heat conductive support and spaced rearwardly of the lens. A pair of high power LED modules are secured to the LED support member and disposed in spaced relationship at a predetermined angle and orientation relative to an inner reflective surface of the circumferential side wall of the reflector whereby to produce a desired oriented photometric light distribution pattern on a plane thereunder to be illuminated. The heat dissipating LED support member transfers heat generated by the LED modules directly into the heat conductive adapter for dissipation in the ambient surrounding air to operate the LED modules at a lower temperature than the critical thermal temperature $T_c$ of the LED modules specified by manufacturer specification to achieve life span, photometric and chronometric rating of the LED modules while generating required lumens in conformity with photometric requirements for the plane to be illuminated.

According to a still further broad aspect of the present invention there is provided a heat dissipating LED support member for high power LED modules and adapted for securement in a sealed optical luminaire housing having a heat conductive support provided with a circumferential reflector and a clear, flat lens is sealingly secured about a bottom open end of the reflector. The heat dissipating LED support member has a securement base for connection to the heat conductive support for heat transfer in the heat conductive support. The LED support member has an LED support outer surface for securement of one or more high power LED modules at a predetermined angle and orientation relative to an inner reflective surface of a circumferential side wall of the reflector whereby to produce a desired oriented photometric light distribution pattern on a plane to be illuminated.

BRIEF DESCRIPTION OF DRAWINGS

A preferred embodiment of the present invention will now be described with reference to the accompanying drawings in which:

FIG. 10 is a Table of the IESNA recommended maintained average horizontal illuminance level (I×) for different types of roads, pavement and pedestrian conditions (excerpt from IESNA 2000);

FIGS. 11A to 11C are Tables of computer print-out test results performed for type I, II and III light distribution using the retrofit sealed optical luminaire of the present invention median mounted with back-to-back luminaires and at different pole spacings and at a fixed height of 30 feet;

FIG. 12A to 12C are Tables similar to FIGS. 11A to 11C but with the luminaires mounted to a side of a roadway;

FIG. 13 is an IP rating chart for street luminaires;

FIG. 14 is a Table of a heat test of the luminaire retrofitted with an LED light source assembly constructed in accordance with the present invention and utilizing two FORTIMO 36 W 5700 LED modules;

DETAILED DESCRIPTION

Figure 1:
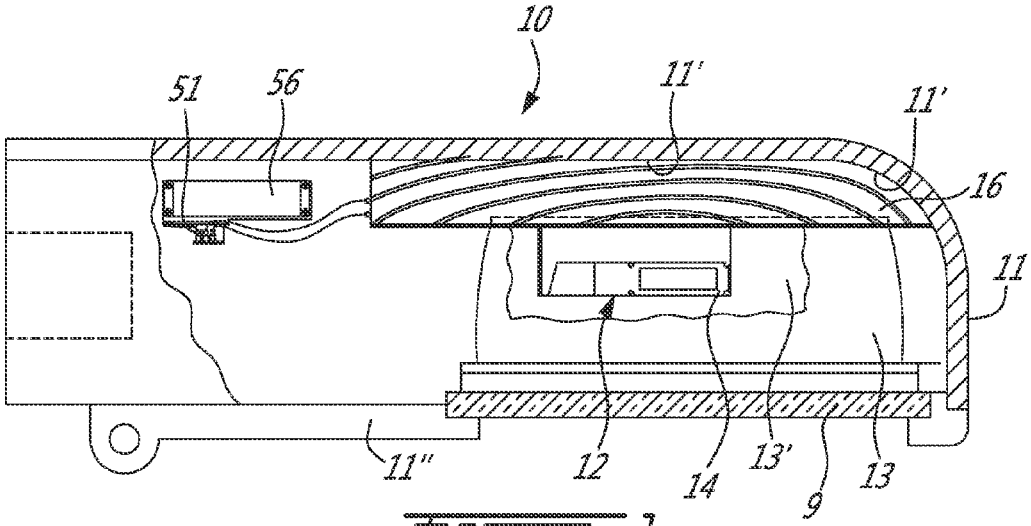
FIG. 1 is a fragmented side view showing a sealed optical street luminaire head of the Cobra-type fitted with a retrofit LED light source assembly constructed in accordance with the present invention.
Figure 2:
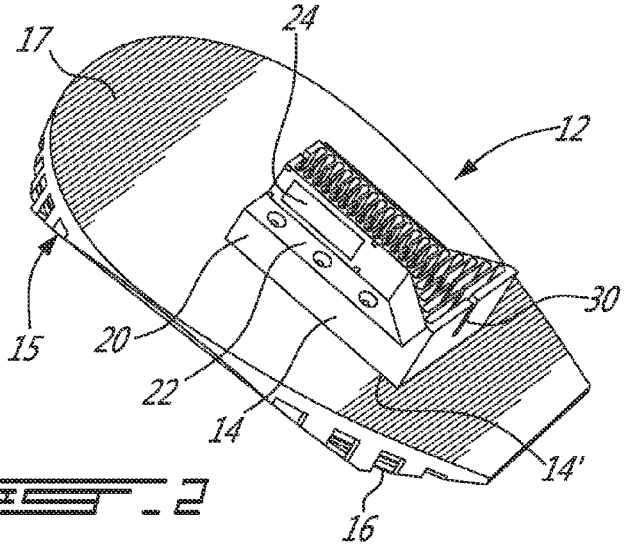
FIG. 2 is a perspective view showing the retrofit LED light source assembly constructed in accordance with the present invention.

Referring now to FIGS. 1 and 2 of the drawings, there is shown a sealed optical street luminaire 10 herein a Cobra street luminaire head manufactured by General Electric and well known in the art. These street luminaires are conventionally fitted with sodium and mercury light bulbs. As hereinshown, the present invention consists of a retrofit comprising an LED light source assembly 12 secured to a heat conductive adapter 15 secured in close fit with the inner surface 11' of the Cobra head housing 11. The housing has a hinged bottom wall 11" for access to the LED light source assembly 12 and mounts a clear lens 9 against a gasket to seal the housing against dust and water infiltration. A reflector 13 is fitted at a lower end of the heat conductive adapter 15 with a lens 9, herein a tempered clear flat glass lens sealingly secured about a lower edge of the reflector. The Cobra head housing 11 is constructed of die-cast aluminum. The reflector 13 is formed of specular hydroformed aluminum and has an internal reflective surface 13'.

The LED light source assembly 12 is comprised of a heat dissipating LED support member 14, as better shown in FIG. 2 which is secured to the heat conductive adapter 15. Both the LED support member 14 and the heat conductive adapter 15 are casted of aluminum and it is foreseen that both the member 14 and adapter 15 could be casted as a single part. The heat conductive adapter 15 is shaped for close fit retention inside the Cobra head housing 11 whereby at least portions of the outer surface 16 of the heat conductive adapter contacts the inner surface 11' of the Cobra head housing 11 for conducting heat thereinto.

Figure 4A:
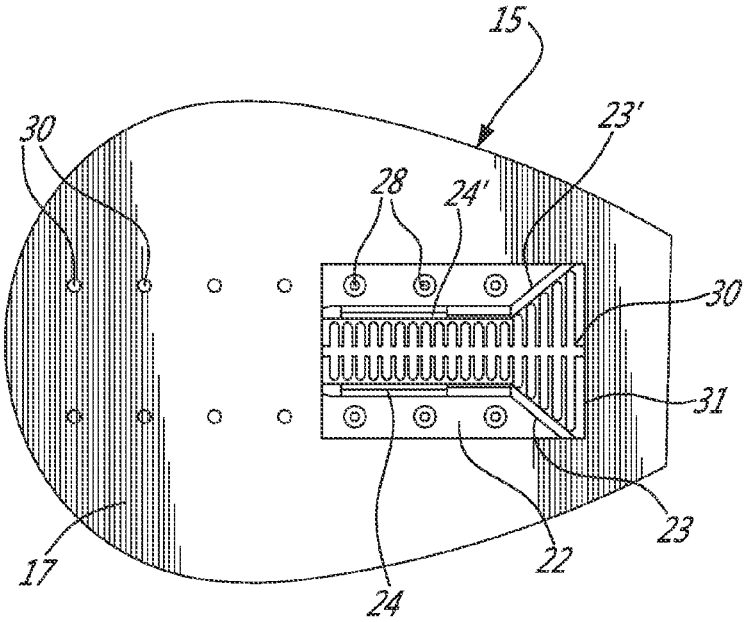
FIG. 4A is a bottom view of the heat conductive adapter illustrating the position of the heat dissipating LED support member and its adjustable feature on the flat heat conductive bottom surface of the heat conductive adapter.
Figure 4B:
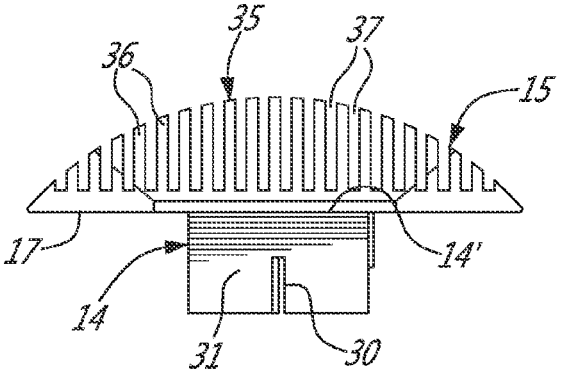
FIG. 4B is an end view of FIG. 4A.
Figure 5:
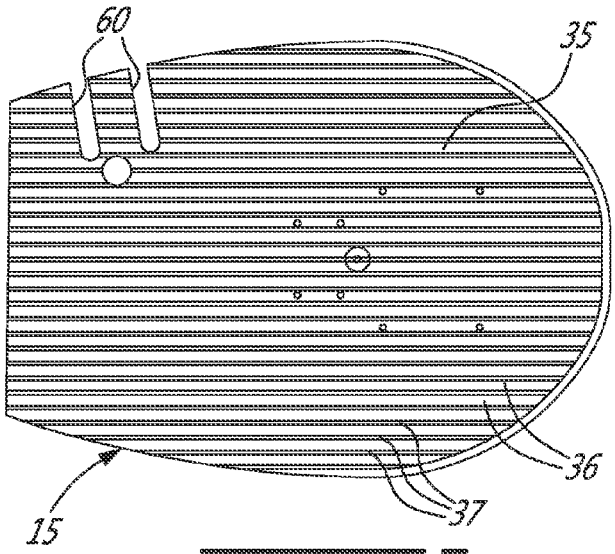
FIG. 5 is a top view of the heat conductive adapter.

With further reference to FIGS. 4A to 5, it can be seen that the heat conductive adapter 15 has a lower mounting surface 17 which is flat and on which the LED support member 14 is secured for flush contact therewith. Preferably, a thermal paste is disposed between the flat bottom wall 14' of the LED support member and the flat lower mounting surface 17 of the heat conductive adapter.

Figure 6A:
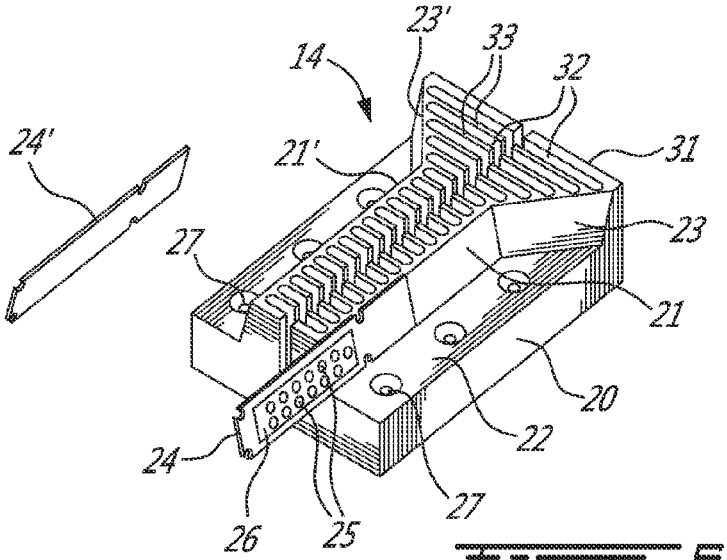
FIG. 6A is a perspective view of the heat dissipating LED support member, partly exploded to show the position of the LED modules thereon.
Figure 6B:
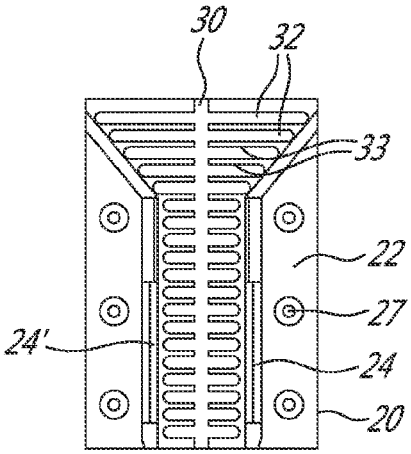
FIG. 6B is a top view of the heat dissipating LED support member.
Figure 6C:
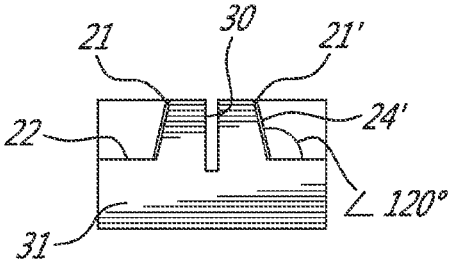
FIG. 6C is an end view, partly fragmented of the Cobra lamp housing as seen form underneath through a clear lens showing the LED light source assembly of the present invention; of the heat dissipating LED support member.

With further reference to FIGS. 6A to 6C, there is better illustrated the construction of the LED support member 14. As hereinshown, the LED support member 14 is constructed of a rectangular block of an aluminum alloy, which is an excellent heat conductor, and defines a base section 20 above which is recessed two LED support surfaces 21 and 21' which are disposed spaced-apart in parallel relationship and are outwardly inclined at an angle of 120°, as shown in FIG. 6C, from the upper recess surface 22 of the base section 20. The thickness of the base section is selected to position the support surfaces 21 and 21' at the focal plane of the reflector. These LED support surfaces 21 and 21' face outwardly inclined towards the reflective inner surface 13' of the reflector which is spaced from and surrounds the LED support member 14. As also shown in FIGS. 6A to 6C, the LED support surfaces 21 and 21' merge into light masking outwardly angled rear reflecting surfaces 23 and 23' whereby to reflect rear emitted light in a forward direction of the photometric light distribution pattern generated by the LED's to improve the luminous flux exiting the reflector.

As shown in FIG. 6A, there are two LED modules 24 and 24' secured to a respective one of the LED support surfaces 21 and 21'. It is also preferable to apply a thermal paste on the LED support surfaces 21 and 21' for better heat conduction with the LED modules. The LED modules are usually secured by fasteners positioned at each end of the module. Also, each of these modules has a plurality of LED's electrically connected together on a PCB board 26. The LED modules 24 and 24' as herein utilized are FORTIMO 36 W 5700 modules manufactured by Philips or other comparable LED modules. These modules have a critical thermal temperature $T_c$ rating of 75° C. and it is important that there is sufficient heat dissipated by the LED support member 14 and the heat conductive adapter 15 as well as the Cobra head housing 11, when used as a retrofit, whereby to maintain the $T_c$ temperature below or in the vicinity of 75° C. to ensure the longevity rating of the LED modules. Tests have shown that the LED light source assembly of the present invention does achieve this heat dissipating requirement and in fact tests have shown that the LED modules operate at temperatures below their $T_c$ rating.

Referring again to FIGS. 6A to 6C and FIG. 4A, it can be seen that the recessed upper surfaces 22 and 22' are provided with through holes 27 extending downwardly in the surfaces whereby to receive bolt fasteners 28 for positioning of the LED modules 24 and 24' at a precise location relative to the reflector. The lower mounting surface 17 is also provided with threaded bores 30 which line up with the holes 27 formed in the recess surface 22 of the LED support member 14. As also shown there are additional threaded bores 30 disposed in spaced apart alignment in the lower mounting surface 17 whereby the LED support member 14 may be located at different precise locations whereby to alter the light distribution pattern on a plane to be lit below the lamp. Accordingly, the LED support member 14 can displace the LED modules at different focal locations with respect to the reflective surface 13' of the reflector, which as shown in FIG. 7 has a circumferential side wall 13".

As can be seen from FIGS. 6A to 6C, the rectangular block which forms the LED support member 14 defines opposed parallel side walls and end walls. An elongated slot 30 extends between the end walls 31 and 31' of the block and spaced behind the opposed LED support surfaces 21 and 21'. A plurality of transverse slots 32 are disposed to each side of the elongated central slot 30 behind the LED support surfaces to define a plurality of equidistantly spaced heat dissipating fins 33. These fins are provided to dissipate heat into the ambient air surrounding the LED support member 14. As well, heat is directly conducted within the base section 20 of the block and into the large heat conductive adapter 15. Ambient air inside the reflector 13 is also conducted through the reflector and the lower mounting surface 17 directly into the large heat conductive adapter 15. This large mass of heat conductive material is sufficient to maintain the critical thermal temperature $T_c$ of the LED modules below their rated temperature. It is pointed out that the LED support member 14 and the conductive adapter 15 may be casted as a single part.

As shown additionally in FIGS. 4A, 4B and 5, the heat conductive adapter 15 is constructed as a large heat sink member and as previously mentioned, has a profiled body for close fit with the profile of the inner surface 11' of the Cobra head housing 11 but could be shaped to fit other lamp head housing of different configurations. As can be appreciated and with reference to FIG. 4B, it can be seen that the heat generated by the LED module is transferred directly into the lower mounting surface 17 or the base of the heat conductive adapter 15 and is dissipated through the Cobra head. As shown in FIG. 4B, the profiled body 35 of the heat conductive adapter 15 is provided with a plurality of large heat dissipating fins 36 extending therealong which define a plurality of channels 37 whereby to provide good heat transfer into the Cobra head lamp housing 11 whereby heat is released in the ambient air. Because of the size of the heat conductive adapter 15 and its large contact area with the Cobra head housing 11, heat is dissipated over a large surface area of the housing 11 and the temperature thereof is maintained within the temperature rating of the Cobra head. Also, because these LED's do not use a transformer and ballast for their power source, but instead use an electronic driver 40', the majority of the heat within the housing is generated only by the LED modules and distributed over a very large portion of the housing 11 to release the heat in the ambient air surrounding the lamp housing.

Figure 7A:
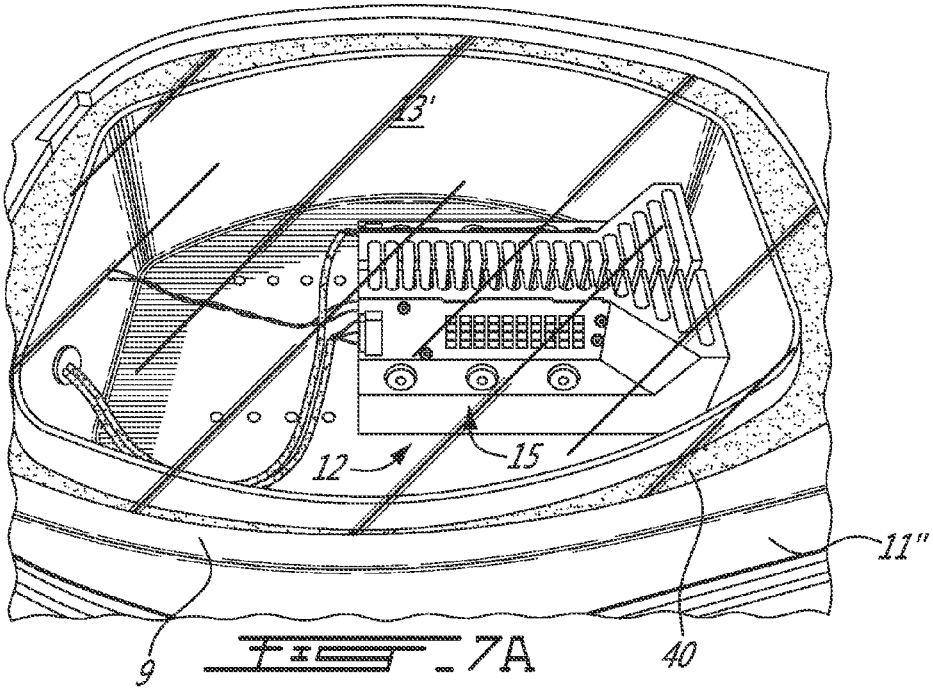
FIG. 7A is a bottom view of the reflector.
Figure 7B:
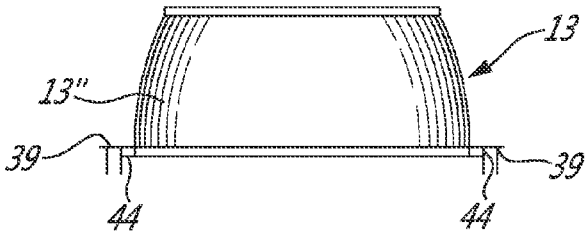
FIG. 7B is an end view of the reflector of FIG. 7A.
Figure 8:
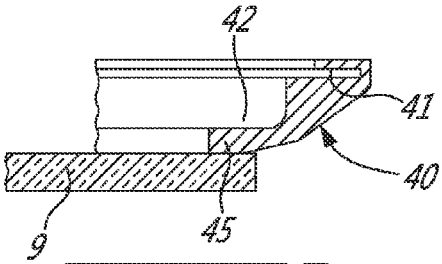
FIG. 8 is a cross-section view of the seal configurated to be secured to the bottom edge of the reflector to receive the lens thereagainst in sealing relationship.

It is important to mention that LED light sources require to be mounted in a clean environment free of dust and therefore the area within the reflector must be sealed to achieve a high IP index. For this purpose and as can be seen in FIGS. 7A and 7B, the reflector 13 is provided with a circumferential lip 39 about which is mounted a sealing gasket 40, a cross-section of which is illustrated in FIG. 8. This gasket 40 is provided with a circumferential horizontal slot 41 which fits about the circumferential lip 39 of the reflector and defines a cavity 42 in which a lower ledge flange 44 of the reflector is received. A sealing lip 45 is disposed over the ledge 44 and the rubber material is adapted to compress when the outer circumference of the lens 9 is clampingly secured thereover. This seal 40 is also rated to maintain its integrity to exceed the life of the LED modules which are rated with a life span of a minimum of 50,000 hours. Existing and traditional street luminaires have a considerably shorter lifespan and therefore require several replacements during 50,000 hours of use and they consume about 450 watts as compared to 77 watts when using LED modules.

Figure 3A:
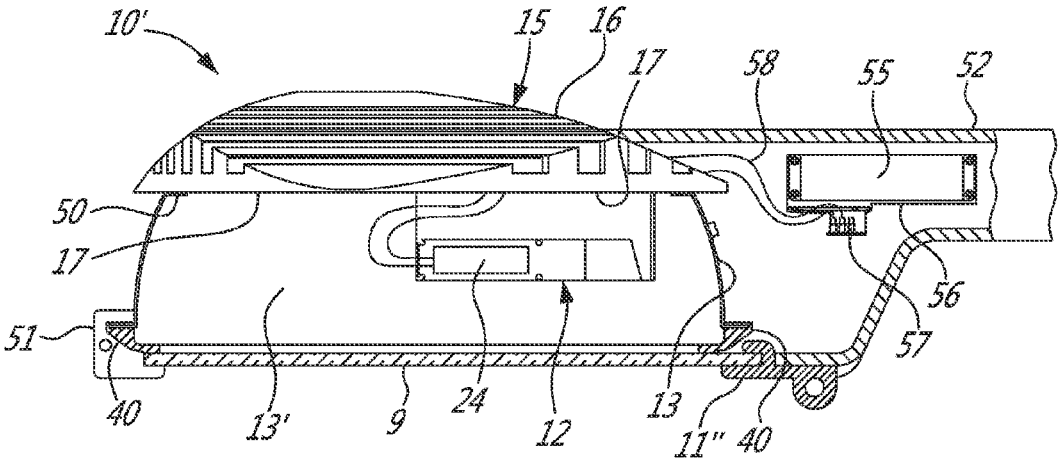
FIG. 3A is a fragmented side view showing another example of a sealed optical luminaire for indoor application constructed with the LED light source assembly of the present invention.
Figure 3B:
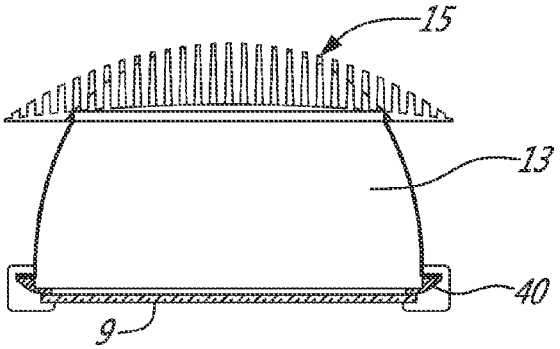
FIG. 3B is a front view of the sealed optical lamp of FIG. 3A.
Figure 9:
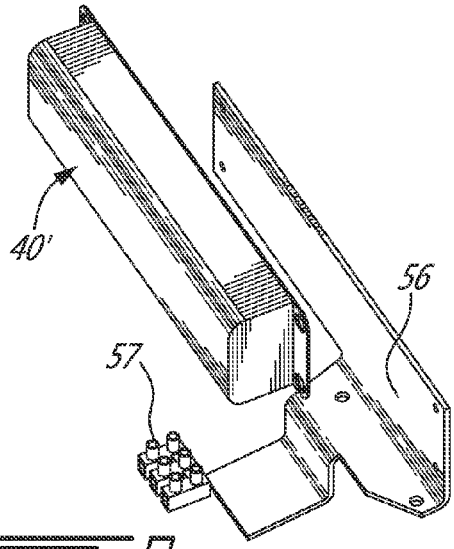
FIG. 9 is an exploded perspective view of the LED driver and its support.

The reflector as shown in FIGS. 7A and 7B is formed of specular hydro-formed aluminum of a type well known in the art and has an internal reflective surface within its circumferential side wall 13" which is of generally oval configuration. As above-mentioned, the base section 20 of the LED support member 14 has a thickness which is predetermined whereby the LED support surfaces 21 and 21' lie at the focal plane of the reflector whereby light generated by the LED's is reflected downwardly in a pattern profile and wherein there is substantially no light loss rearwardly or upwardly towards the lower mounting surface 17 of the heat conductive adapter. The LED modules are high brightness modules (HBM) and with two of these mounted, as above-described for retrofit within a Cobra head, they can produce the desired lumen on a task plane to be illuminated. In the particular retrofit application described, such street luminaires have been able to provide the desired IESNA recommended average horizontal illuminance levels for an expressway-type of road application with high, medium and low conflict area and for an asphalt surface rated R2 and R3, see the Table in FIG. 10. However, it is foreseen that the sealed optical luminaire may be constructed for other lighting uses and as illustrated in FIGS. 3A and 3B, the heat conductive adapter 15 may be modified to constitute the head of a sealed optical indoor luminaire 10'. The reflector 13 is hereinshown provided with a top securement flange 50 for attachment to the lower mounting surface 17 of the heat conductive adapter with the lens 9 being provided with clamping connectors 51 to clamp the clear, flat lens about the circumferential seal 40. The heat conductive adapter 15 is also secured to a post support member 52 in which the driver shown at 55, as better illustrated in FIG. 9, is secured to a support 56. The support 56 is also provided with a terminal connector 57 to receive wires 58 from the LED modules. These wires 58 extend through slots 60 (see FIG. 5) formed in the heat conductive adapter 15.

With the embodiment of FIGS. 3A and 3B, it can be seen that heat generated by the LED modules is transferred into the head of the luminaire which is the heat conductive adapter 15 and dissipated directly into the ambient air. The fins 36 formed in the head also provide excellent heat transfer. Being indoor, the fins 36 are protected from debris.

Various other seal optical luminaire applications are foreseen with the use of the LED light source assembly of the present invention and this being achieved by providing a heat dissipating mounting assembly as above-described which may vary in size and shape depending on the rating of the LED modules utilized and the luminaire shape or design. It is also further foreseen that more LED modules of different sizes can be mounted on the LED support surfaces 21 and 21' and as well as on the light masking surfaces 23 and 23', provided that the dimensions of the LED support member 14 and heat conductive adapter 15 be sufficient to maintain the total critical thermal temperature $T_c$ rating of the LED modules to achieve the lifespan rating of the LED modules while generating the required lumens on a task plane to be illuminated and in conformity with the photometric requirements.

FIG. 10 is a well known chart to luminaire designers and is reproduced herein for purpose of background information and for reasons that such has been referred to herein.

FIGS. 11A to 11C are Tables illustrating the heat test results of a retrofitted sealed optical street luminaire of the Cobra-type. As hereinshown by the test results both LED modules operated at an average case temperature below the specified rating, thus satisfying the rating of 75° C. to achieve maximum life expectancy. These tests represent pavement classification R2 (FIG. 11A) and R3 (FIG. 11B), see FIG. 10, with poles of spacings from 120 feet to 180 feet and the luminaire supported at a height of 30 feet. Two luminaires where supported back-to-back on a median mounting at a height of 30 feet. The test results were performed for type I, II and III light distribution.

FIGS. 12A to 12C are Tables illustrating the heat test results of the retrofitted Cobra type luminaire operated at an average case temperature below the above-mentioned rating of the LED modules These test results represent pavement classification R1 (FIG. 12A), R2 (FIG. 12B) and R3 (FIG. 12C) with the poles side mounted to the roadway at spacings of from 120 feet to 180 feet and the luminaire supported at a height of 30 feet. The test results were performed for type I, II and II light distribution.

It is pointed out that from the test result, it is conducive that the retrofit luminaire of the present invention is suitable for various road classifications, as indicated on the FIG. 10 Chart.

The luminaire of the present invention can be adapted to illuminate major, collector and local roads to meet the RP-08-00 Standards with pole spacings of from 120 feet to 180 feet with the luminaire supported at a height of 30 feet and depending on pedestrian conflict area.

With reference to FIG. 13, luminaire ingress protection is the degree of protection provided by its enclosure or optical chamber. In many cases, the level of protection is marked on the luminaire in the form of an "IP" code. The optical chamber IP rating of the present invention is IP 65. This code indicates an optical chamber totally protected against dust (first digit 6) piece of equipment which is protected against low pressure water jets (second digit 5) allowing the luminaire to be used in applications where high dust/water resistance is required.

FIG. 14 is a Table of the IP test results of the luminaire constructed in accordance with the present invention as a retrofit in a Cobra luminaire head.

Figure 15A:
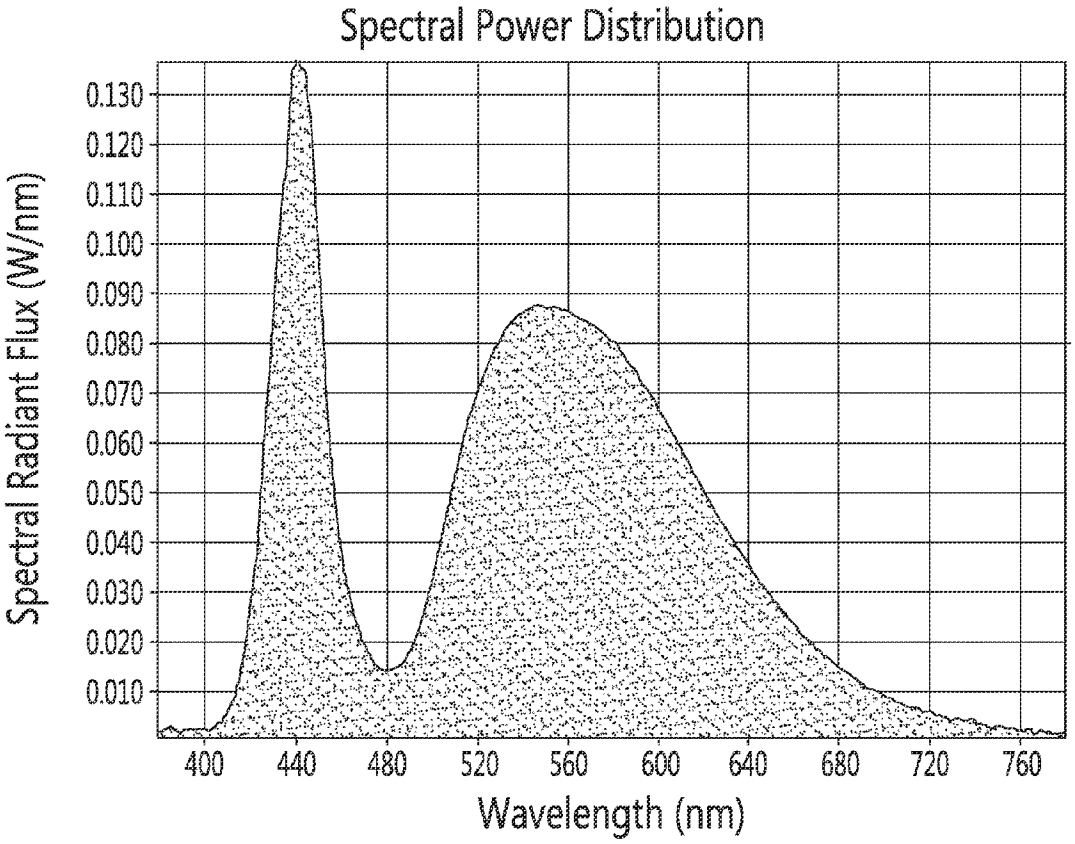
FIGS. 15A and 15B are spectro power distribution and chromaticity diagrams showing the results of a sphere test using the LED light source assembly of the present invention fitted in a Cobra luminaire head and utilizing two FORTIMO 36 W 5700 LED modules driven by a Xitanium 150 W 0.700 A driver.
Figure 15B:
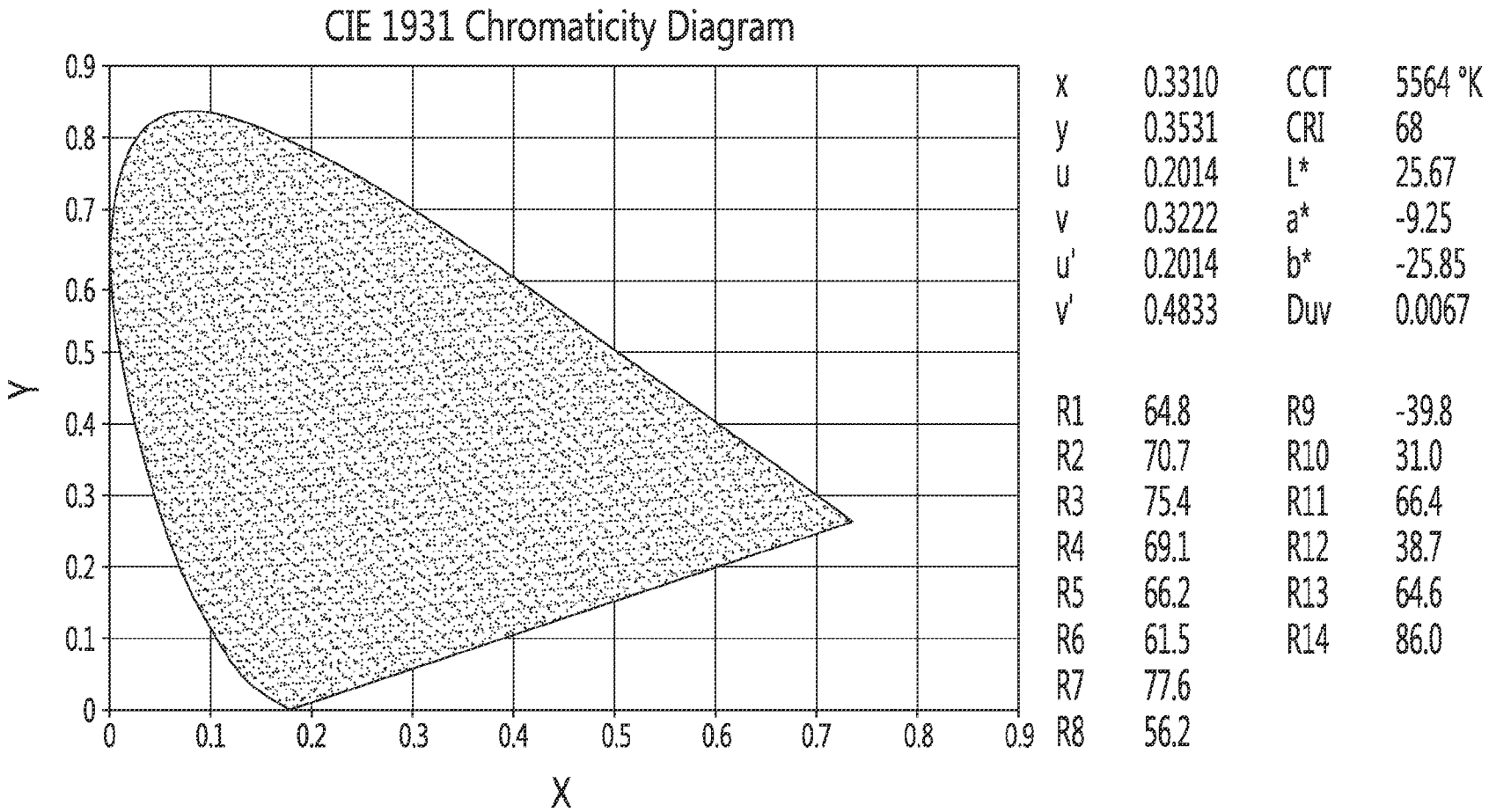
Figure 16A:
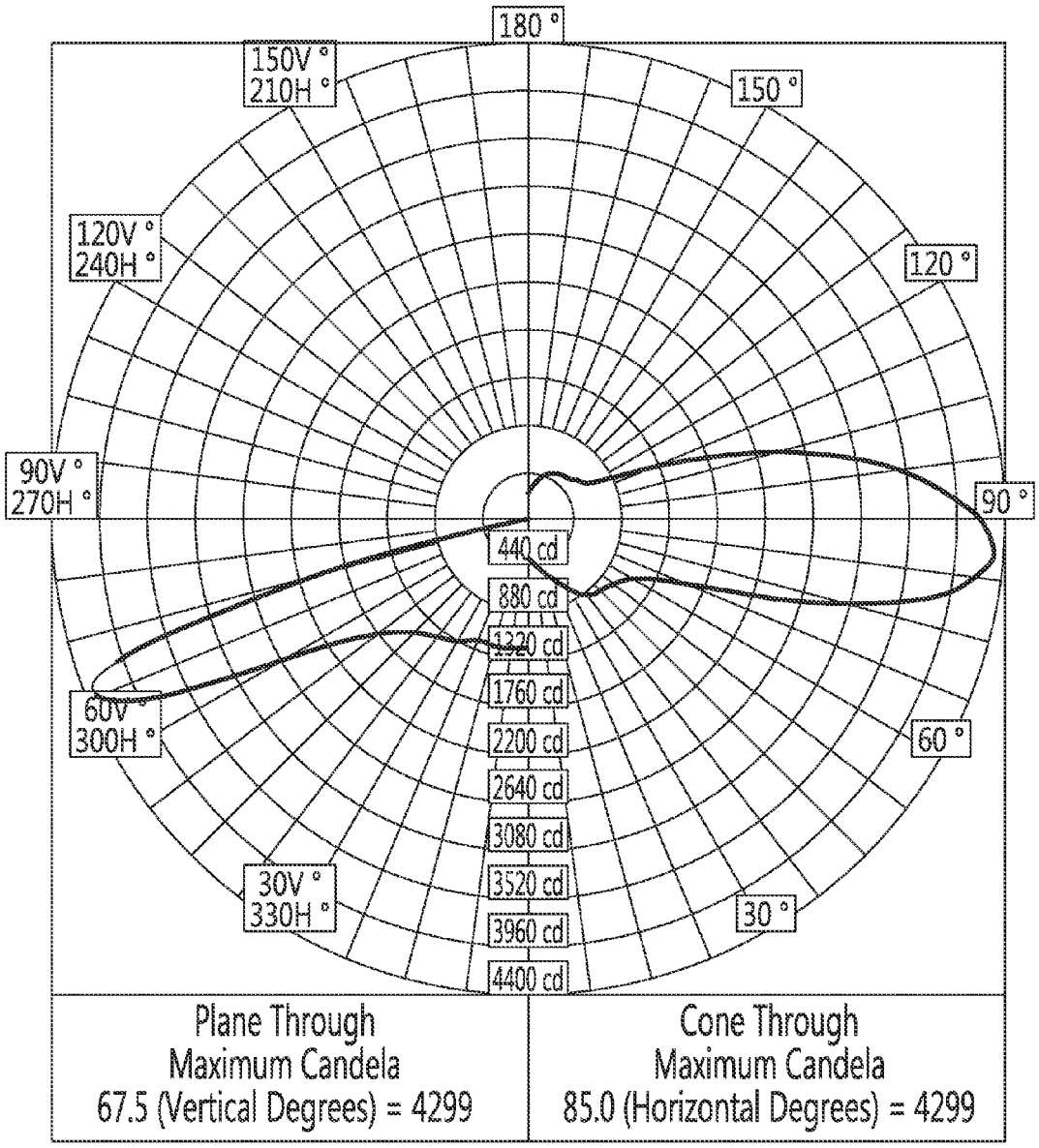
FIGS. 16A and 16B are photometric reports and isoluminance diagram illustrating the photometric luminaire characteristics as per IESNA RP-8-00 test.
Figure 16B:
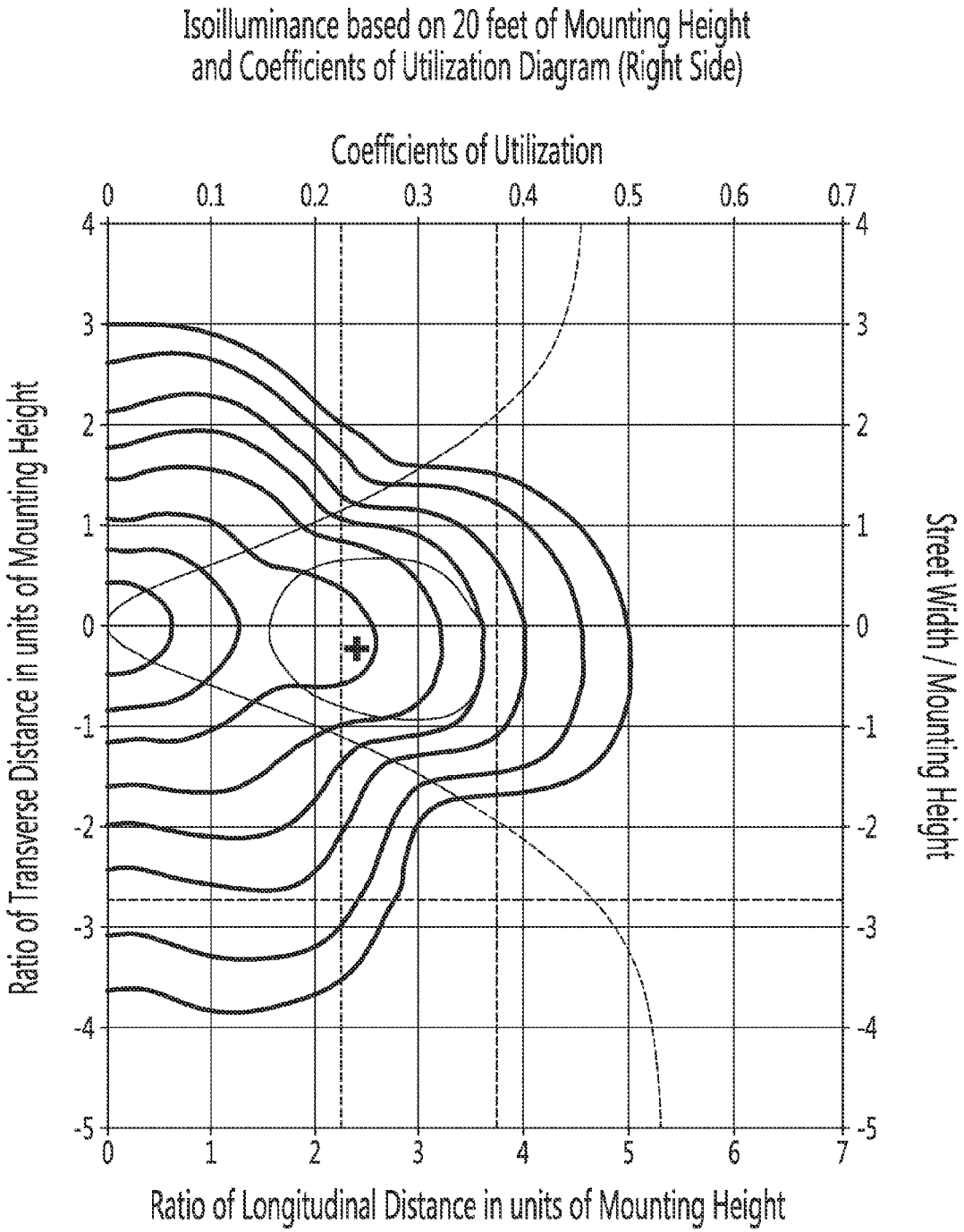

FIGS. 15A and 15B are diagrams of a sphere test of the retrofitted Cobra luminaire with the LED light source assembly of the present invention using two FORTIMO HBM 5700, 36 watt LED modules and as can be seen, FIGS. 16A and 16B are computer generated cone plots and light distribution patterns of the luminaire with respect to the test of FIG. 11A.

Figure 17A:
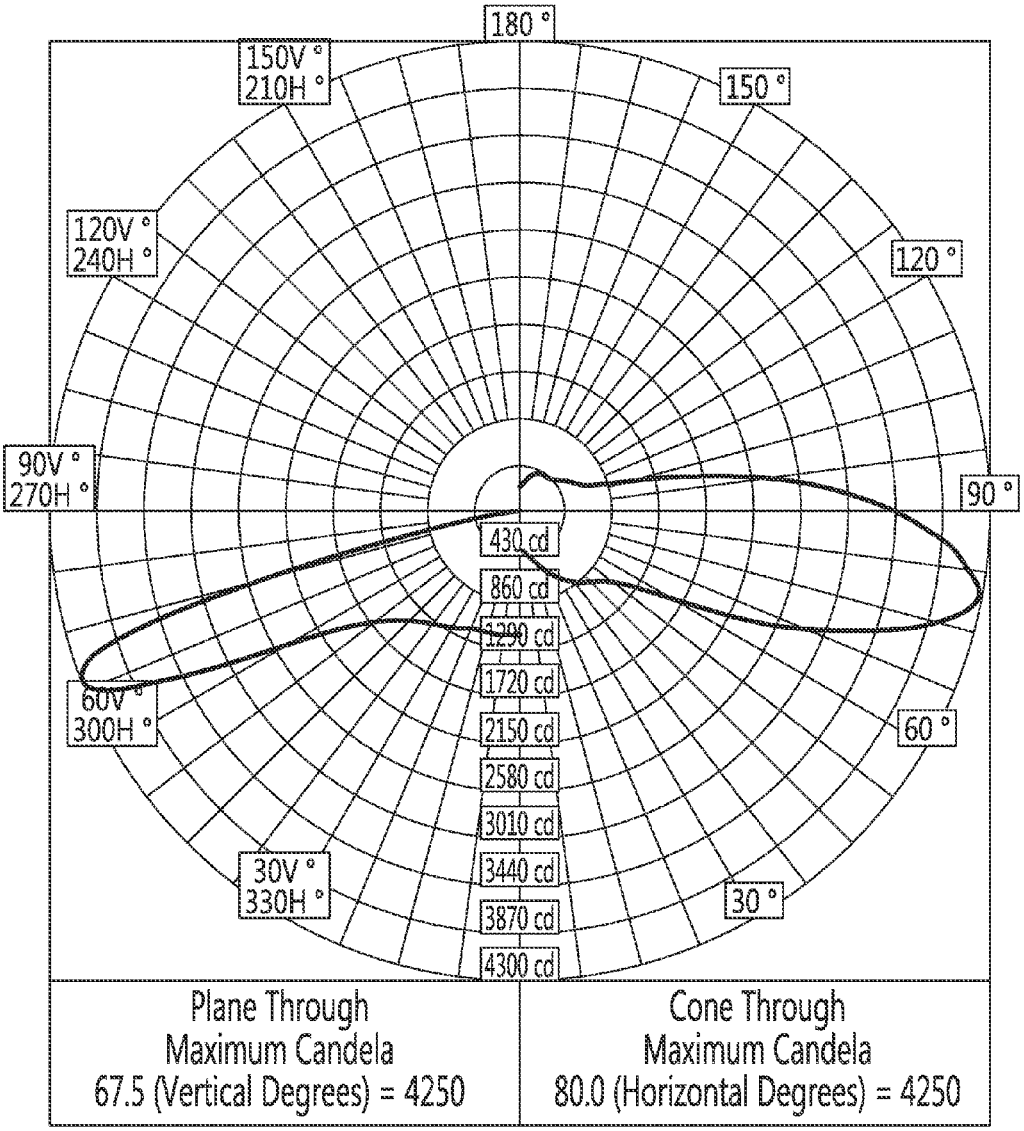
FIGS. 17A and 17B are diagrams illustrating maximum plane and cone plots of Candela (1) tests and coefficient of utilization diagram right side of the photometric luminaire characteristics as per IESNA RP 8-00 type 2.
Figure 17B:
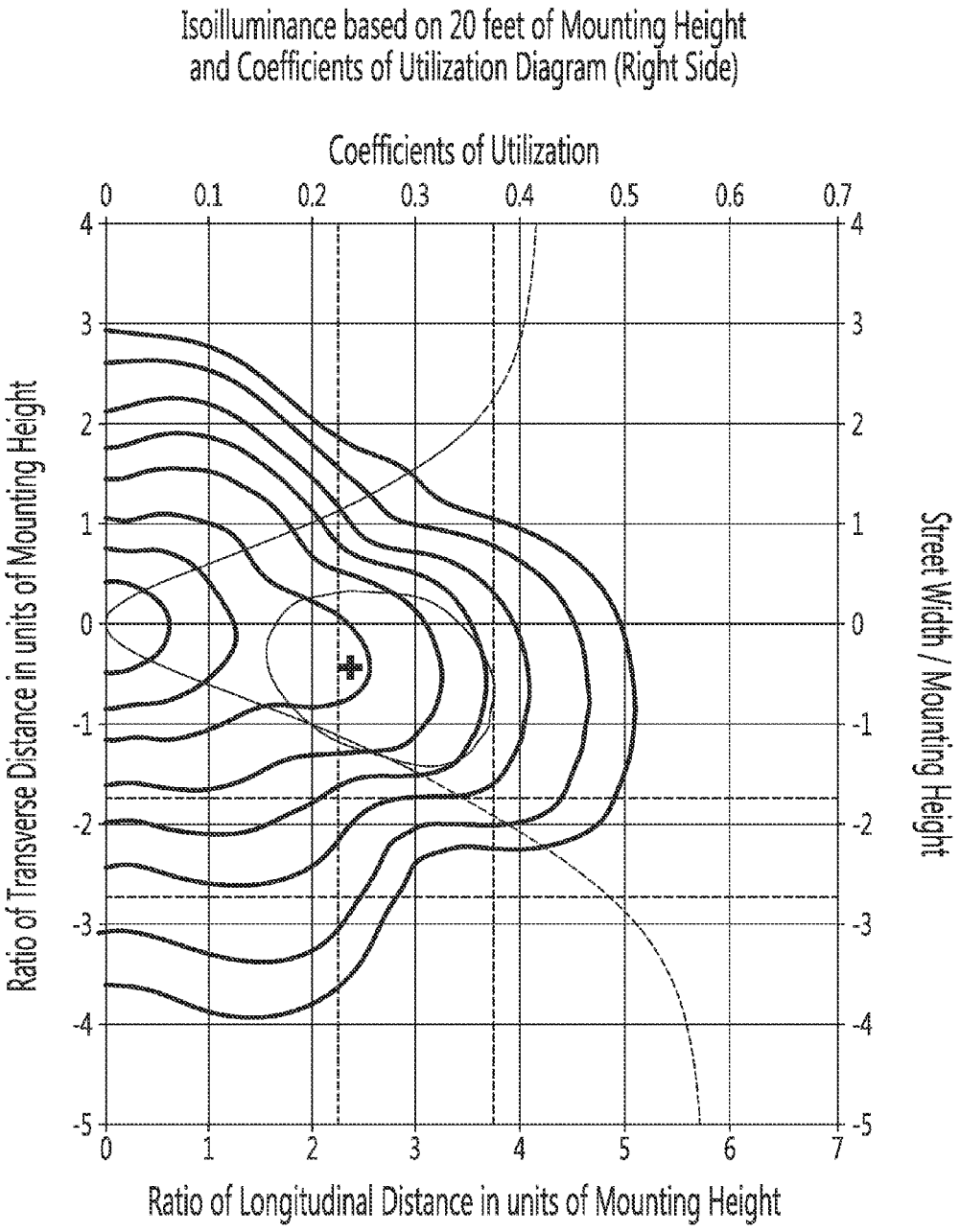

FIGS. 17A and 17B are computer generated cone plots and light distribution patterns of the luminaire with respect to the tests of FIG. 11B.

Figure 18A:
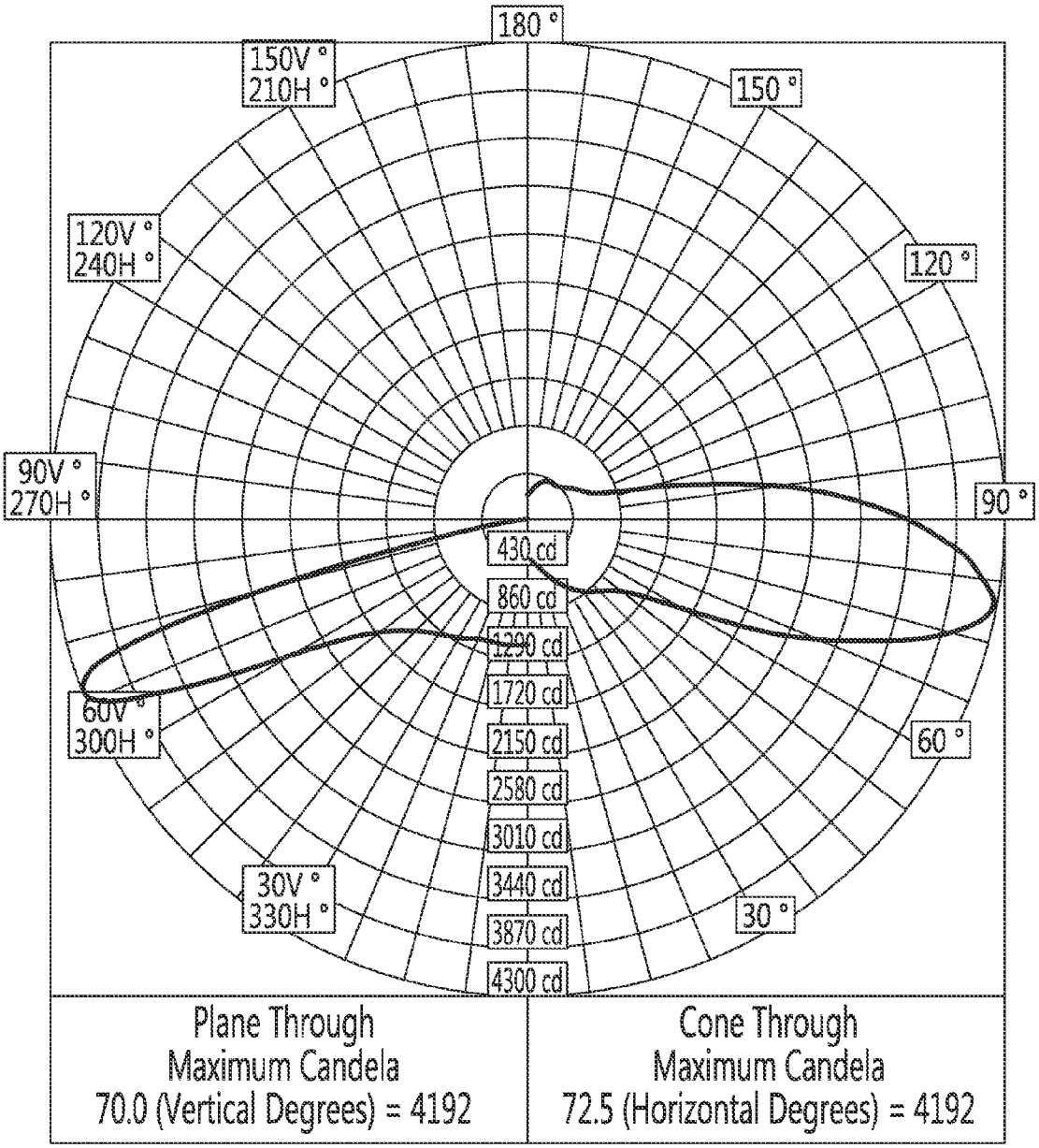
FIGS. 18A and 18B are diagrams illustrating maximum plane and maximum cone plots and coefficients of utilization diagram right side, respectively, of photoluminaire characteristics as per IESNA RP 8-00 type 3.
Figure 18B:
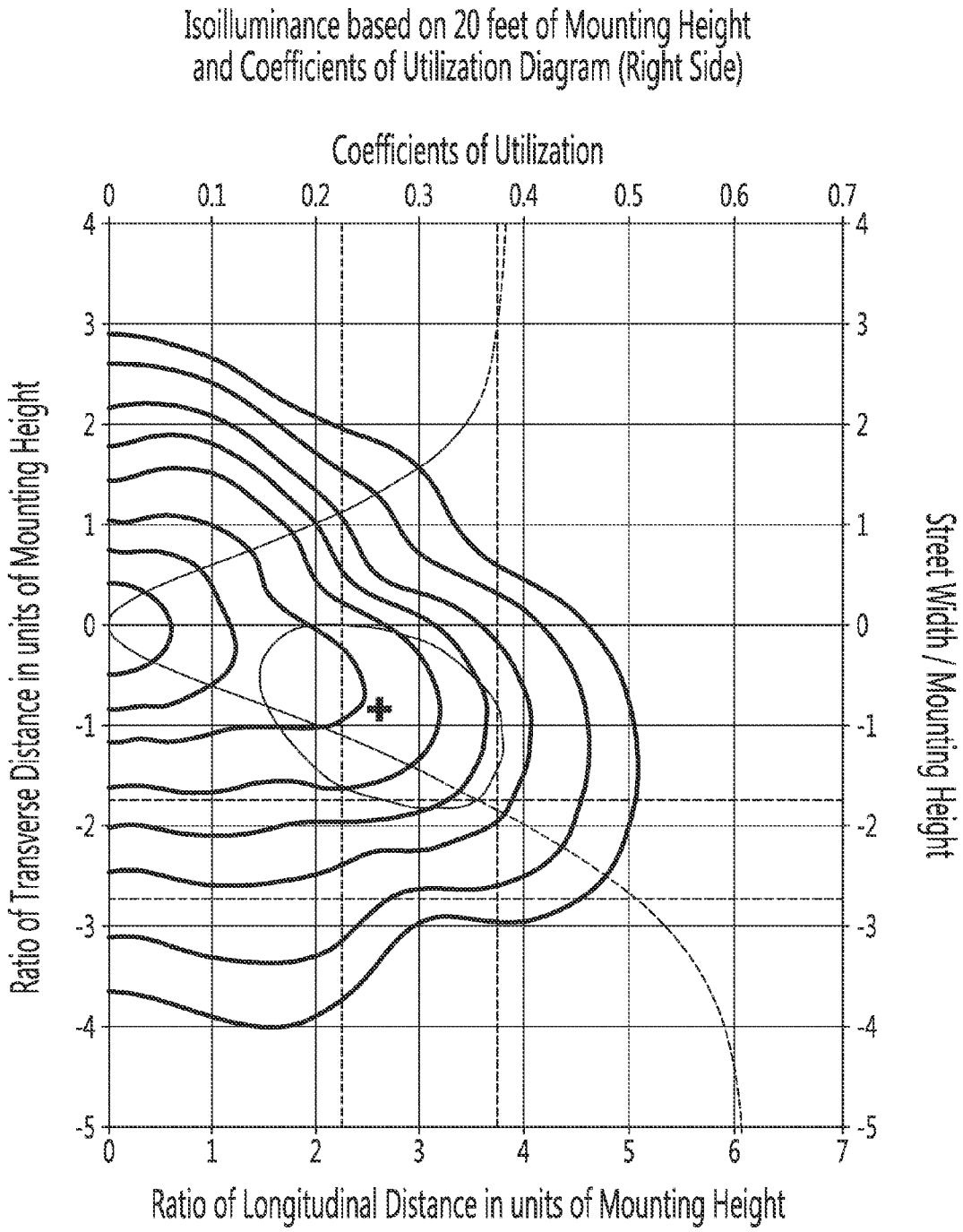

FIGS. 18A and 18B are computer-generated cone plots and light distribution patterns of the luminaire with respect to the tests of FIG. 11C.

It is within the ambit of the present invention to cover any obvious modifications of the preferred embodiment described herein provided such modifications fall within the scope of the appended claims.

We claim:

1. A sealed optical street luminaire having a luminaire housing fitted with a clear, flat lens, an LED light source assembly mounted in said housing, said LED light source assembly having a heat dissipating LED support member, a heat conductive support for securement in said luminaire housing with at least portions thereof in contact with at least a heat conductive portion of said luminaire housing, a reflector is secured in said luminaire housing behind said lens, a seal secured about a circumferential side wall of said reflector and disposed for sealing engagement with said lens, said LED support member having an LED support outer surface for securement of one or more high power LED modules at a predetermined angle and orientation relative to an inner reflective surface of said circumferential side wall of said reflector whereby to produce a desired oriented photometric light distribution pattern on a plane to be illuminated, said heat dissipating LED support member comprising a support block transferring heat generated by said LED modules directly into said heat conductive support for dissipation through said luminaire housing and having a heat dissipating capacity to operate the LED modules at a lower temperature than the critical thermal temperature $T_c$ of said LED modules specified by manufacturer specification to achieve lifespan, photometric and colorometric rating of said LED modules while generating required lumens in conformity with photometric requirements for said plane to be illuminated.

2. A sealed optical street luminaire as claimed in claim 1 wherein said heat conductive support has a flat mounting surface on which said heat dissipating LED support member is secured.

3. A sealed optical street luminaire as claimed in claim 2 wherein said mounting surface is a flat mounting surface disposed parallel to said lens, said reflector circumferential side wall being secured to said flat mounting surface about said heat dissipating LED support member.

4. A sealed optical street luminaire as claimed in claim 3 wherein said LED support member has a flat rear surface in flush contact with said flat mounting surface, and fastening means to secure said LED support member at a predetermined location on said flat mounting surface.

5. A sealed optical street luminaire as claimed in claim 4 wherein said LED support member is adjustably secured on said flat mounting surface with respect to said reflector to alter the light distribution pattern on said plane to be illuminated.

6. A sealed optical street luminaire as claimed in claim 5 wherein said flat mounting surface is provided with groups of threaded bores for mounting said LED support member at different predetermined positions to alter the photometric light distribution pattern on said plane to be lit.

7. A sealed optical street luminaire as claimed in claim 3 wherein said heat conductive support block comprises a base section, said base section having a flat rear mounting surface, said LED support outer surfaces being opposed spaced-apart and parallel extending surfaces, said support surfaces being outwardly inclined surfaces facing said reflective surface of said circumferential side wall of said reflector in opposed directions, and fastening means to secure said LED support member at a predetermined location with respect to said reflector with said flat rear mounting surface in contact with a flat surface of said mounting surface.

8. A sealed optical street luminaire as claimed in claim 7 wherein said LED support surfaces merge into light masking outwardly angled rear reflecting surface to reflect rear emitted light in a forward direction of said reflector to generate said photometric light distribution pattern.

9. A sealed optical street luminaire as claimed in claim 8 wherein said heat conductive support is a rectangular aluminum block having opposed parallel side walls, said LED support surfaces being disposed recessed in an upper section of said heat conductive support block and defining a ledge thereadjacent, and holes extending downwardly in said ledges to receive bolt fasteners constituting said fastening means.

10. A sealed optical street luminaire as claimed in claim 8 wherein said heat conductive support block is a rectangular block having opposed parallel side walls and end walls, an elongated central slot extending in a top wall of said rectangular block between said end walls and spaced behind said opposed LED support surfaces, and a plurality of transverse slots disposed to each side of said elongated central slot behind said LED support surfaces to constitute heat dissipating fins.

11. A sealed optical street luminaire as claimed in claim 7 wherein said LED support surfaces are each disposed on a rearward inclined plane lying at an angle of 120° from said flat rear mounting surface.

12. A sealed optical street luminaire as claimed in claim 11 wherein said LED modules are high brightness modules, said LED light source assembly generating a luminous efficacity of about 120 lumens/watt.

13. A sealed optical street luminaire as claimed in claim 1 wherein said LED support surfaces are disposed at a focal location of said reflective surface of said circumferential side wall of said reflector.

14. A sealed optical street luminaire as claimed in claim 1 wherein said heat conductive support is a heat sink member and wherein said mounting surface is a flat surface, said heat sink member having a profiled body for close fit with the profile of an inner surface of a head portion of said luminaire housing, and a plurality of heat dissipating fins formed in said profiled body, and securement means for securing said heat conductive support to said head portion of said luminaire.

15. A sealed optical street luminaire as claimed in claim 14 wherein said lamp housing is a Cobra™ luminaire housing, said LED light source assembly being a retrofit light source assembly.

16. A sealed optical street luminaire as claimed in claim 15 wherein said retrofit light source assembly is provided with an LED driver assembly.

17. A sealed optical street luminaire as claimed in claim 1 wherein said dissipating LED support member and said heat conductive support are casted as an integral part.

18. A sealed optical street luminaire as claimed in claim 1 wherein said high power LED modules comprise a pair of high brightness modules, each module having a printed circuit board on which is secured a plurality of LED's, a cable connector secured to said module for connection of an LED driver thereto, said critical thermal temperature being an average temperature maintained at least below 80° C. at ambient temperatures within the range of −40° C. to 60° C.

* * * * *